US006405728B1

(12) United States Patent
Van Hall et al.

(10) Patent No.: US 6,405,728 B1
(45) Date of Patent: Jun. 18, 2002

(54) BREATHING APPARATUS

(75) Inventors: Maurice Van Hall, Bedlington; David Ian Middleton, Annitsford; Henri Schwegman, Ponteland; James Leslie McMillan, Sidcup; Ian Barrett, Cramlington, all of (GB)

(73) Assignee: Draeger Limited, Northumberland (GB)

( * ) Notice: Subject to any disclaimer, the term of this patent is extended or adjusted under 35 U.S.C. 154(b) by 0 days.

(21) Appl. No.: 08/658,849

(22) Filed: May 31, 1996

(30) Foreign Application Priority Data

Jun. 9, 1995 (GB) ..... 9511737

(51) Int. Cl.[7] ..... A62B 7/00; A62B 9/00

(52) U.S. Cl. ..... 128/205.22; 128/204.18; 128/205.15; 128/202.13

(58) Field of Search ..... 128/204.18, 201.27, 128/201.28, 201.29, 202.13, 202.19, 204.26, 205.15, 205.22, 201.25

(56) References Cited

U.S. PATENT DOCUMENTS

| | | | | | |
|---|---|---|---|---|---|
| 932,880 | A | * | 8/1909 | Meikle | 128/201.29 |
| 2,238,759 | A | * | 4/1941 | Vestrem | 128/201.27 |
| D143,084 | S | | 12/1945 | Littlefield et al. | |
| D143,097 | S | | 12/1945 | Schneider | 128/204.18 |
| 2,406,334 | A | | 8/1946 | Keller et al. | |
| 2,406,888 | A | * | 9/1946 | Meidenbauer, Jr. | 128/205.24 |
| 2,844,145 | A | | 7/1958 | Berge | 128/201.29 |
| 2,975,439 | A | | 3/1961 | Bentley | 128/204.26 |
| 2,982,105 | A | | 5/1961 | Akers | 61/70 |
| D205,487 | S | | 8/1966 | Goldwater et al. | |
| 3,680,556 | A | * | 8/1972 | Morgan | 128/201.27 |
| D231,571 | S | | 4/1974 | Parker | |
| D233,741 | S | | 11/1974 | Lahargoue | |
| 3,957,183 | A | | 5/1976 | Gadberry | |
| 4,054,132 | A | | 10/1977 | Deeds | 128/201.27 |
| 4,062,356 | A | | 12/1977 | Merrifield | 128/204.18 |
| D251,622 | S | | 4/1979 | Garrison et al. | 128/200.29 |
| 4,195,949 | A | * | 4/1980 | Reiher | 128/202.12 |
| 4,250,816 | A | * | 2/1981 | Kranz | 128/204.18 |
| 4,331,141 | A | | 5/1982 | Pokhis | 128/204.28 |
| 4,383,528 | A | * | 5/1983 | Eppolito | 128/204.18 |
| 4,438,764 | A | | 3/1984 | Eppolito | 128/205.22 |
| 4,494,538 | A | | 1/1985 | Ansite | 128/205.25 |
| 4,498,471 | A | * | 2/1985 | Kranz et al. | 128/204.26 |
| 4,582,054 | A | | 4/1986 | Ferrer | 128/200.23 |
| 4,739,913 | A | | 4/1988 | Moore | 128/205.22 |
| 4,791,921 | A | * | 12/1988 | Robison | 128/201.27 |
| 4,911,346 | A | | 3/1990 | Shallman | 224/221 |
| 4,938,211 | A | | 7/1990 | Takahashi et al. | 128/204.28 |
| 5,046,492 | A | | 9/1991 | Stackhouse et al. | 128/200.27 |
| D321,956 | S | | 11/1991 | Williamson | D29/7 |
| 5,188,267 | A | | 2/1993 | Sargent et al. | |
| 5,203,325 | A | | 4/1993 | Carr | 128/202.26 |
| 5,243,972 | A | | 9/1993 | Huang | 128/205.25 |
| 5,361,955 | A | | 11/1994 | Gregory | 224/211 |
| 5,370,113 | A | | 12/1994 | Parsons | 128/205.22 |
| 5,400,934 | A | | 3/1995 | Ducros | 128/205.22 |
| 5,429,125 | A | | 7/1995 | Wagner et al. | 128/205.25 |
| 5,435,305 | A | | 7/1995 | Rankin, Sr. | 128/205.22 |
| 5,490,501 | A | | 2/1996 | Crowley | 128/204.17 |
| 5,492,110 | A | | 2/1996 | Lenz et al. | 128/202.22 |

FOREIGN PATENT DOCUMENTS

| | | | |
|---|---|---|---|
| GB | 146838 | 6/1921 | |
| GB | 661235 | 3/1949 | |
| GB | 2059750 | 4/1981 | A62B/9/04 |
| GB | 2223930 | 4/1990 | A45F/3/08 |
| IT | 485203 | 5/1956 | |
| IT | 618370 | 3/1965 | |

* cited by examiner

*Primary Examiner*—John G. Weiss
*Assistant Examiner*—Michael Mendoza
(74) *Attorney, Agent, or Firm*—Seyfarth, Shaw

(57) ABSTRACT

A breathing apparatus comprises at least one spherical container (15) for breathable gas attached to a harness (1,9,20,21) (5) (109) for securing the same to a user. Each container may be located within a protective casing (14,14') and is preferably formed of composite material.

10 Claims, 19 Drawing Sheets

BREATHING APPARATUS

BACKGROUND OF THE INVENTION

1. Field of the Invention

This invention relates to breathing apparatus and more particularly, but not exclusively, is concerned with breathing apparatus for use by the fire fighting services.

2. Description of the Prior Art

Breathing apparatus are known comprising one or more cylindrical containers for storing breathable gas and a harness for securing the cylinder(s) to the back of the user of the apparatus. However the cylinders tend to be long and heavy and are rather unwieldy to carry because the centre of gravity is high up on the wearer's back.

SUMMARY OF THE INVENTION

It is an object of the present invention to provide a breathing apparatus which can be more readily carried by the wearer.

According to the present invention there is provided a breathing apparatus comprising:

(i) a substantially spherical container for holding breathable gas under pressure, and (ii) a harness to which the container is attached for securing the container to the user.

By making use of a substantially spherical container, it is possible to arrange for the centre of gravity to be lower down the back of the wearer to assist in the comfort and manoeuvrability of the wearer when carrying the apparatus.

The apparatus may comprise more than one of said substantially spherical containers connected together by means of a suitable manifold. In this case it is preferred that the containers are charged simultaneously and discharged simultaneously. By providing a variable number of containers, it is possible to accommodate variable breathing consumption rates and variable durations of use in order to render the apparatus suitable for a wide variety of operational circumstances.

In accordance with one embodiment of the invention, a single spherical container is provided. This embodiment is suitable for use for short periods of time such as when escaping from a hostile environment or when carrying out quick and/or simple tasks. In this case, the harness may be in the form of a waist belt or waist coat for fastening around the user and to which the container is secured. If desired, the waist belt may be in the form of a fire-fighter's DIN standard safety belt with the container secured thereto by suitable "snap-on" attachments. Alternatively, the harness may be in the form of a bandolier arranged to extend diagonally around the body of the user.

Similar harnesses may be used in the case where the apparatus includes two of said containers.

However, when the apparatus includes two (or more) containers, it is preferred for the harness to be a full harness including both a waist belt and also shoulder straps for looping around the shoulders of the wearer. In this case, it is particularly preferred for the harness to include a waist plate providing lumbar support as a consequence of having a back portion for engaging the back of the wearer and side portions, at each end of the back portion, having lips at their upper edges for seating on the hips of the wearer. Optionally, the harness additionally includes a spinal support plate for engaging the spine of the wearer. The spinal support plate is preferably pivotable in a vertical plane generally parallel to the back of the wearer and/or flexible in a direction perpendicular to that plane. It also may be height adjustable.

It is particularly preferred for the breathing apparatus to include a protective casing for the container(s) formed of lightweight non-flammable antistatic material. In the case where a single container only is provided, this may be in the form of a bag accommodating the container and affixed to the harness. In the case where the breathing apparatus includes more than one container, then the casing is preferably a relatively rigid container. Where two containers are provided, these are preferably located side-by-side within a single casing and, in an embodiment, the casing may include sufficient space to accommodate a third container above the first and second containers so that the containers are located at the apices of a triangle. In this way, the user can include two or three containers as desired depending on the purpose of use of the apparatus.

In the case where the apparatus includes four containers, these are preferably located in pairs with one pair above the other and each pair in its own separate casing with the casings interlocking together to provide additional stability and security.

In the case where more than one container is used, quick connections are preferably provided to enable them to be connected to the necessary manifold. Generally, in each case, the casing includes two openings only namely a high pressure inlet leading to the container (or, in the case where more than one container is present, to a manifold connecting the containers together) for charging the container(s) with gas and an outlet linked to the container or manifold as the case may be via a pressure reducer so that gas at medium pressure can be fed to the demand valve of the apparatus to enable the user to breathe the gas. If desired the casing may be provided with heat-insulation and with a radiation-reflective surface.

By totally enclosing the container(s) in a casing, there is much less risk of the apparatus snagging on any protrusions or trailing wires in the vicinity and the container(s) and pressure reducer, manifold and the like are less vulnerable to accidental damage. Moreover, cleaning and particularly decontamination of the apparatus after use is greatly simplified. Generally, the containers only need to be removed from the casing when it is needed to carry out periodic pressure testing.

It is particularly preferred for the container(s) to be formed from a composite material such as, for example, resin impregnated graphite fibres in which case they can be produced by a filament winding technique. Such composite containers are preferred because of their light weight. If desired, however, containers formed from, for example, steel or aluminium may be used.

The containers may contain any breathable gas but generally this will be compressed breathing air.

BRIEF DESCRIPTION OF THE DRAWINGS

For a better understanding of the invention and to show how the same may be carried into effect, reference will now be made, by way of example, to the accompanying drawings in which.

In the drawings, corresponding parts are denoted by like reference numerals.

DESCRIPTION OF THE PREFERRED EMBODIMENTS

Figure 1:
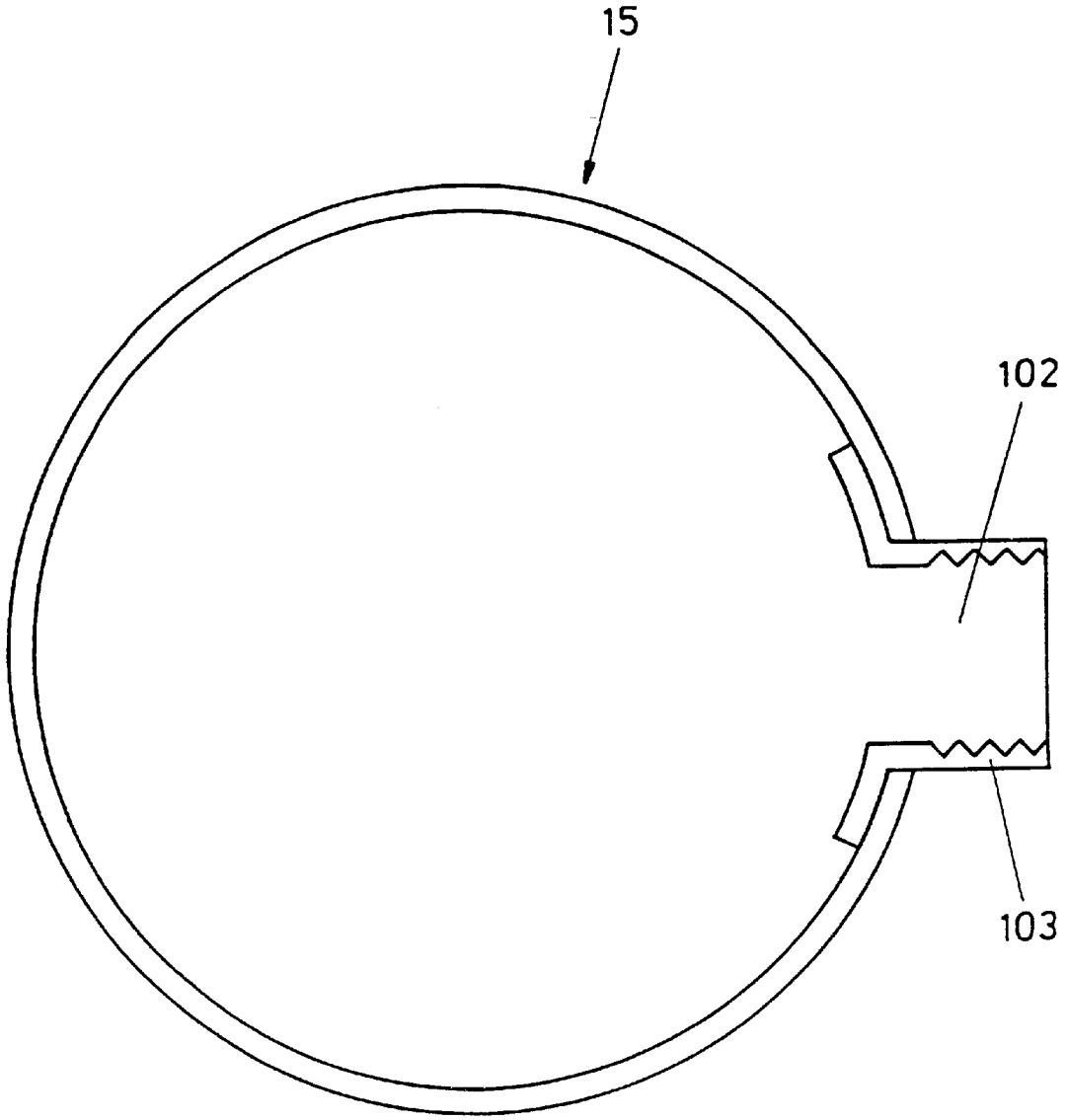
FIG. 1 is a cross section through a substantially spherical container for breathable gas forming part of a breathing apparatus in accordance with the present invention.

Referring now to FIG. 1, there is shown a substantially spherical container 15 for storing breathable gas under pressure. The container is formed from resin impregnated carbon fibre composite material by means of a filament winding technique and incorporates an inlet 102 terminating in an internally threaded portion 103 whereby it may be charged with air and air may be subsequently removed for breathing purposes. The inlet protrudes beyond the surface of the container. Alternatively, the inlet may be provided in a recess in the container surface. In this case, a more compact arrangement can be obtained.

Figure 2:
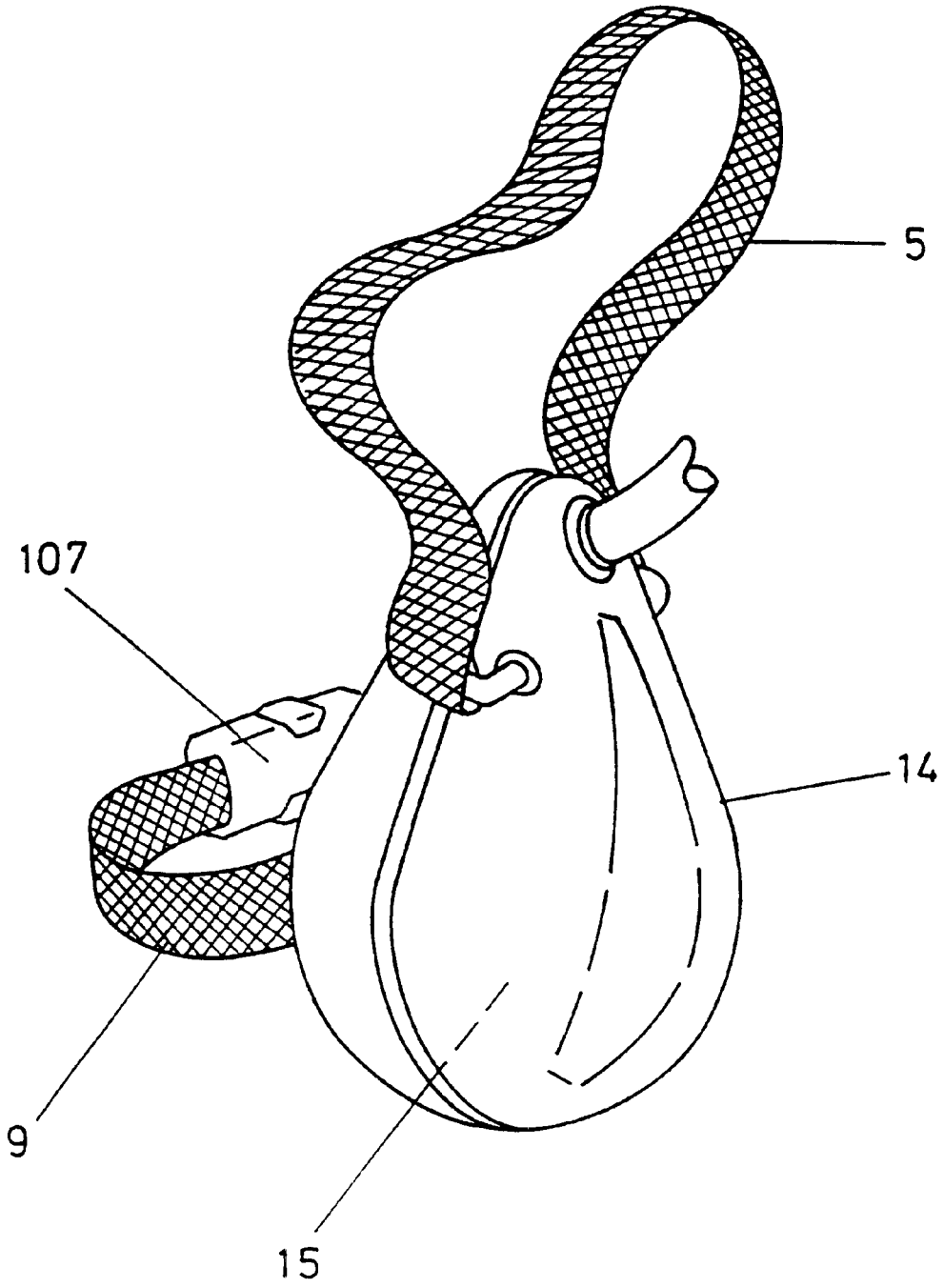
FIG. 2 shows a rear perspective view of a first embodiment of breathing apparatus in accordance with the present invention.

As can be seen from FIG. 2, the container is located within a protective casing 14 provided with a single opening through which passes a conduit in communication with connector 103 whereby air may be introduced into and removed from the container 15. A demand valve (as denoted by reference numeral 70 in FIG. 18) is operably connected to connector 103 to enable the wearer to breathe from the container 15. The casing 14 is formed of rigid or flexible non-flammable antistatic plastics material and is attached to a bandolier 5 arranged to pass diagonally around the wearer's body and also to a waist belt 9 provided with a fastener 107 for attaching around the wearer's waist. This embodiment is a small capacity breathing apparatus suitable for short durations such as, for example, when making an escape from a hostile environment such as a smoke filled building.

Figure 3:
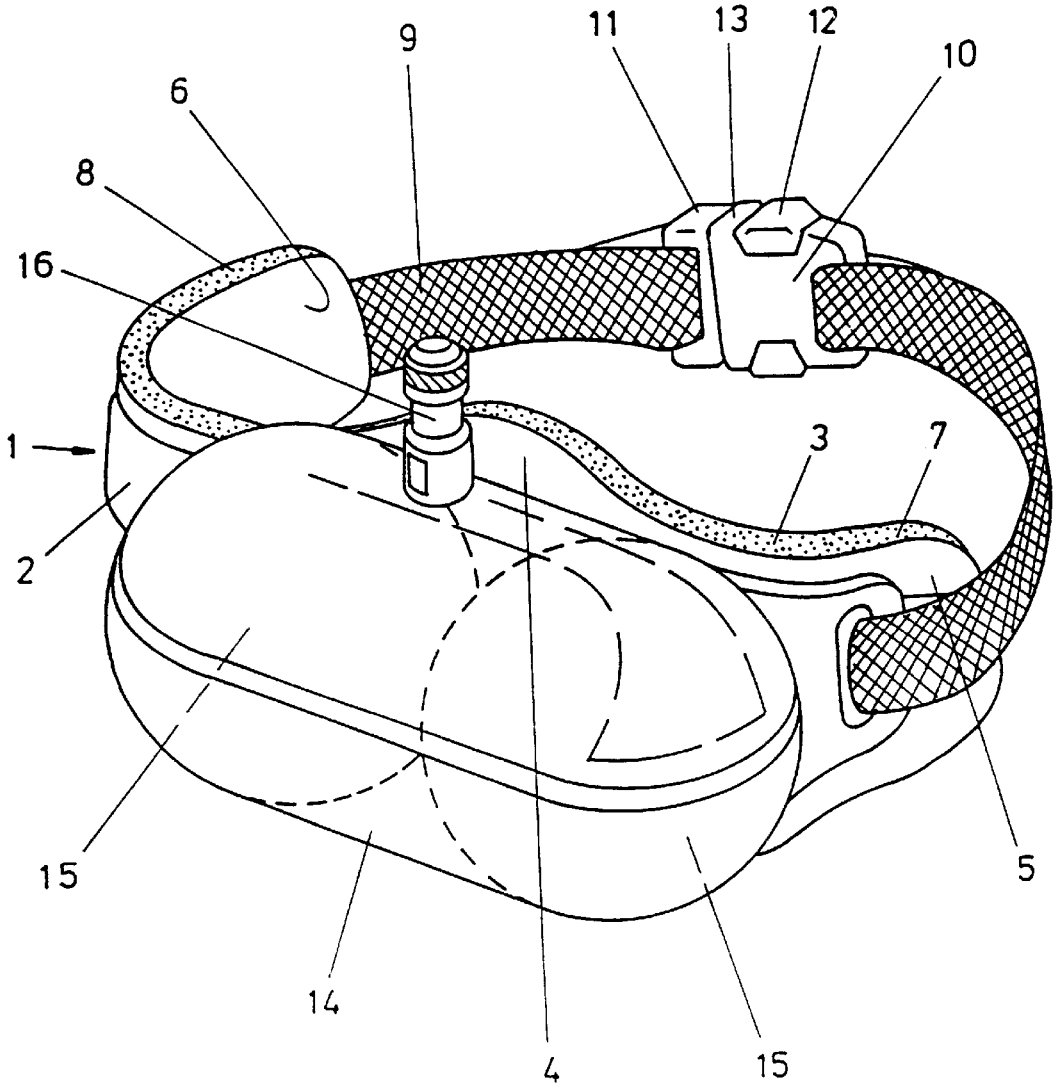
FIG. 3 is a rear perspective view of a second embodiment of breathing apparatus in accordance with the present invention.

Referring now to FIG. 3, the apparatus includes a harness which comprises a waist plate 1 comprising a rigid supporting member 2 formed of plastics material (such as the linear polyamide known as nylon) faced with padding 3 formed of a resilient material such as foamed plastics material. The waist plate 1 is ergonomically shaped so as to provide lumbar support. More particularly it includes a back portion 4 for engaging the back of the wearer and side portions 5 and 6, at each end of the back portion, for engaging the hips of the wearer. Each of the side portions 5 and 6 has a lip 7 and 8, respectively, at its upper edge for seating on the hip of the wearer.

A waist belt 9 formed of webbing is secured to the waist plate 1. The waist belt includes a connector comprising a female portion 10 at one of its free ends and a male portion 11 at the other of its free ends. The male portion 11 comprises two resilient projections which are capable of entering the female portion 10 as a consequence of being displaced towards one another. They include shoulders 12 which engage with abutments 13 on the female portion when the projections return to their non-displaced position when fully entered into the female portion and which retain the male portion within the female portion. A means (not shown) is provided to enable the length of the waist belt 9 to be adjusted.

Figure 12:
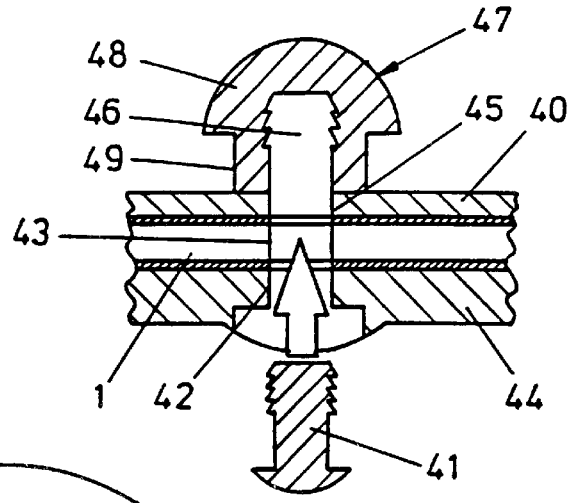
FIG. 12 is a section through FIG. 11 along the line XII—XII.
Figure 11:
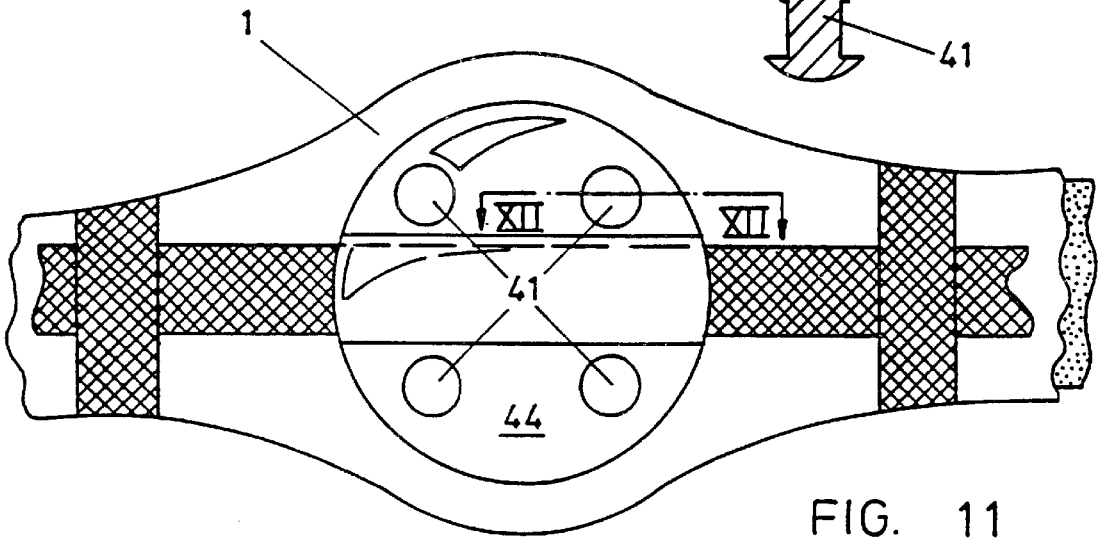
FIG. 11 is a front view of part of the apparatus of FIG. 8.
Figure 13:
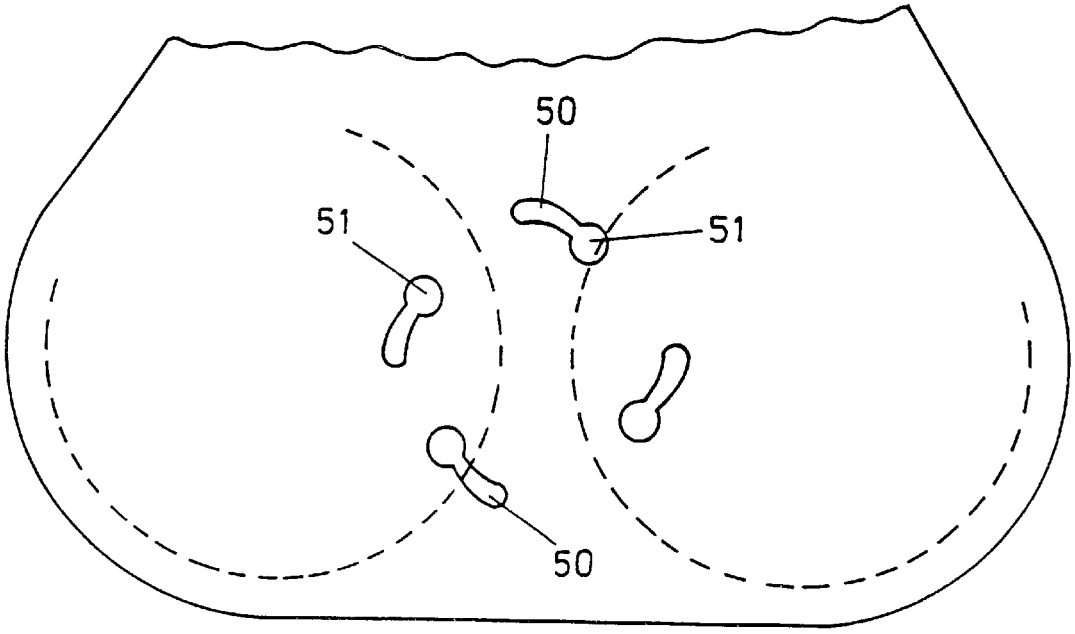
FIG. 13 is a front view of another part of the apparatus of FIG. 8.

Attached to the waist belt 9 is a durable rigid casing 14 carrying two of the substantially spherical containers 15 for holding breathing gas under pressure. The casing 14 is secured to the waist plate 1 in the manner shown in FIGS. 11, 12 and 13 described hereinafter. The containers 15 are each linked via a manifold (not shown) to a high pressure inlet 16 passing through an opening in the casing 14 for charging the containers with gas. Gas is taken from the containers 15 by means of a medium pressure outlet (not shown) connected to the manifold by means of a pressure reducer (not shown).

In use, the harness is fitted around the back and sides of the wearer so that the lips 7 and 8 rest on the top of the hip bones of the wearer and the waist belt 9 is tightly secured about the waist of the wearer by means of the male and female connector portions, the length of the belt being adjusted as appropriate by the adjustment means (not shown). In this way, the harness is locked onto the wearer's waist and hips in a comfortable manner and allows negligible movement of the containers 15 with respect to the wearer. Moreover, the containers 15 are located at a low position with respect to the body of the wearer and hence the weight distribution enables the apparatus to be carried relatively easily.

Figure 4:
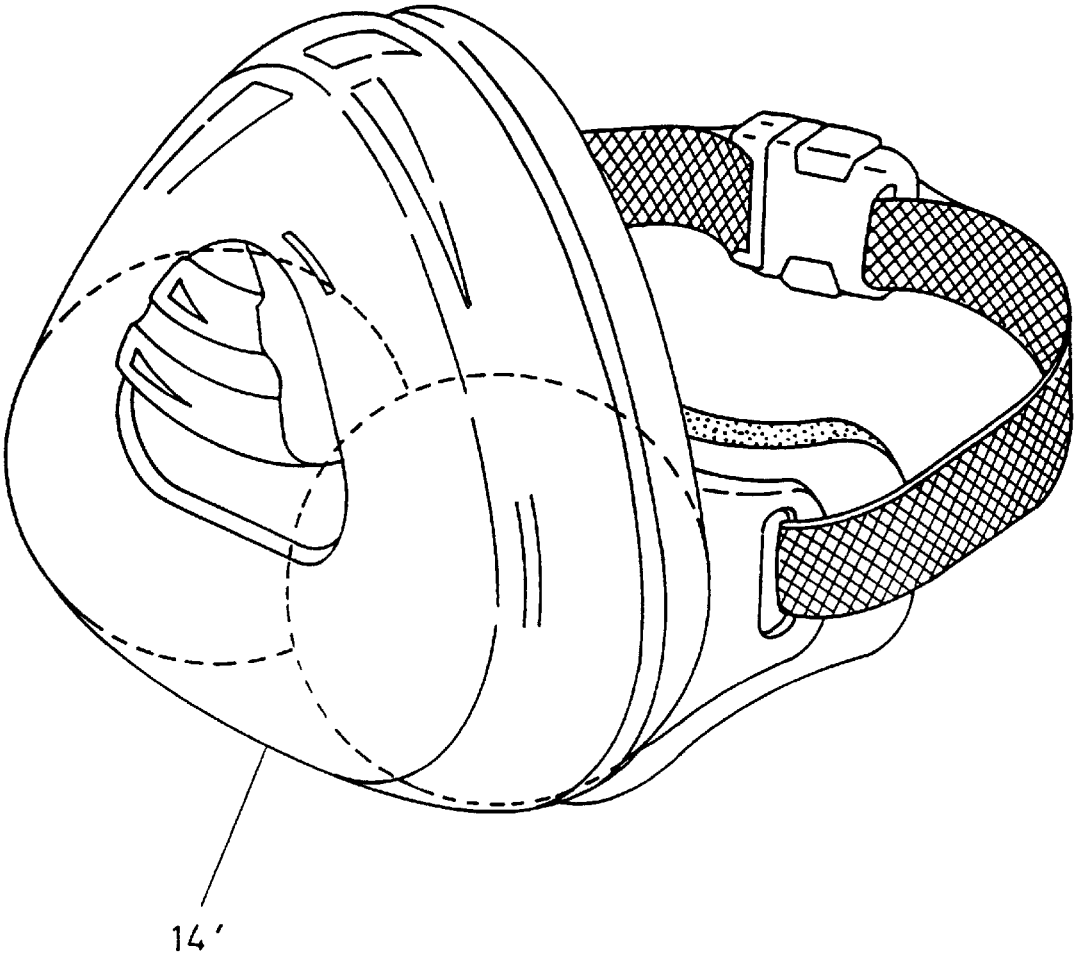
FIG. 4 is a rear perspective view of a third embodiment of breathing apparatus in accordance with the present invention.

Referring now to FIG. 4, this embodiment is substantially similar to that of FIG. 3 except that the casing 14' is capable of accommodating an additional spherical container if deemed desirable by the user. In this case the third container is suitably connected to the manifold so that it can be charged and emptied simultaneously with the other containers.

Figure 5:
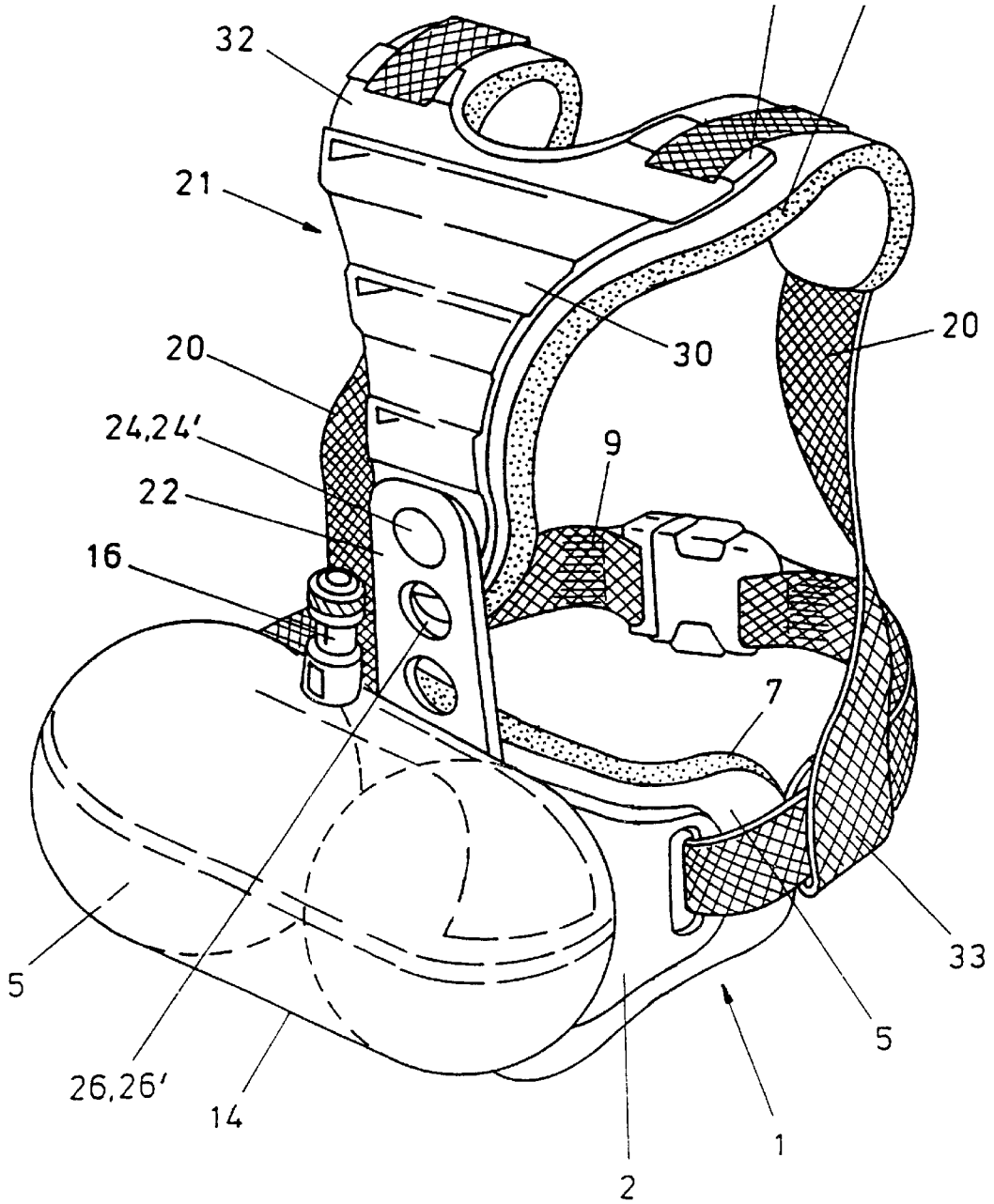
FIG. 5 is a rear perspective view of a fourth embodiment of breathing apparatus in accordance with the present invention.
Figure 6:
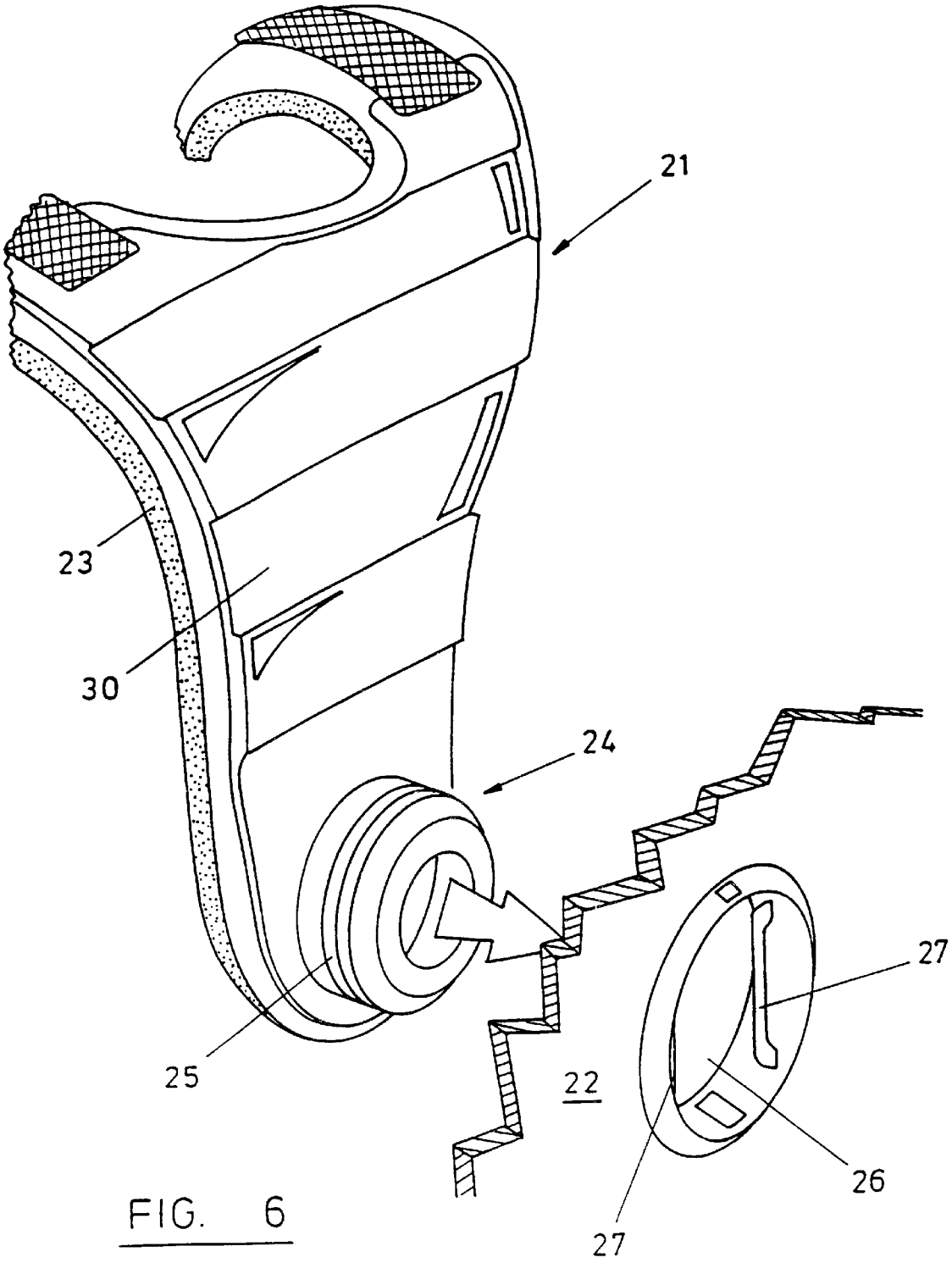
FIG. 6 is a rear perspective view of a part of the breathing apparatus of FIG. 5.
Figure 8:
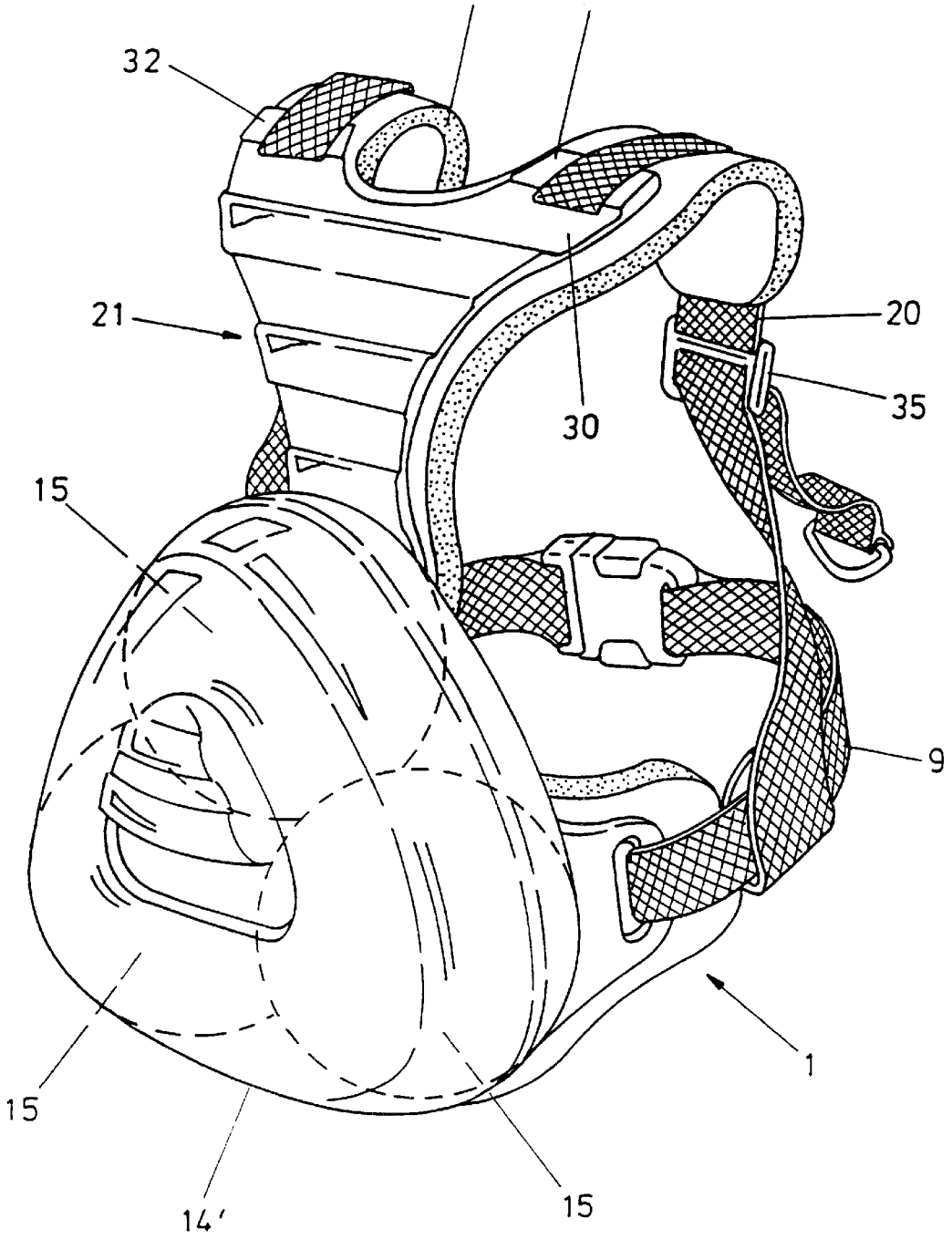
FIG. 8 shows a rear perspective view of a breathing apparatus in accordance with a fifth embodiment of the present invention.
Figure 9:
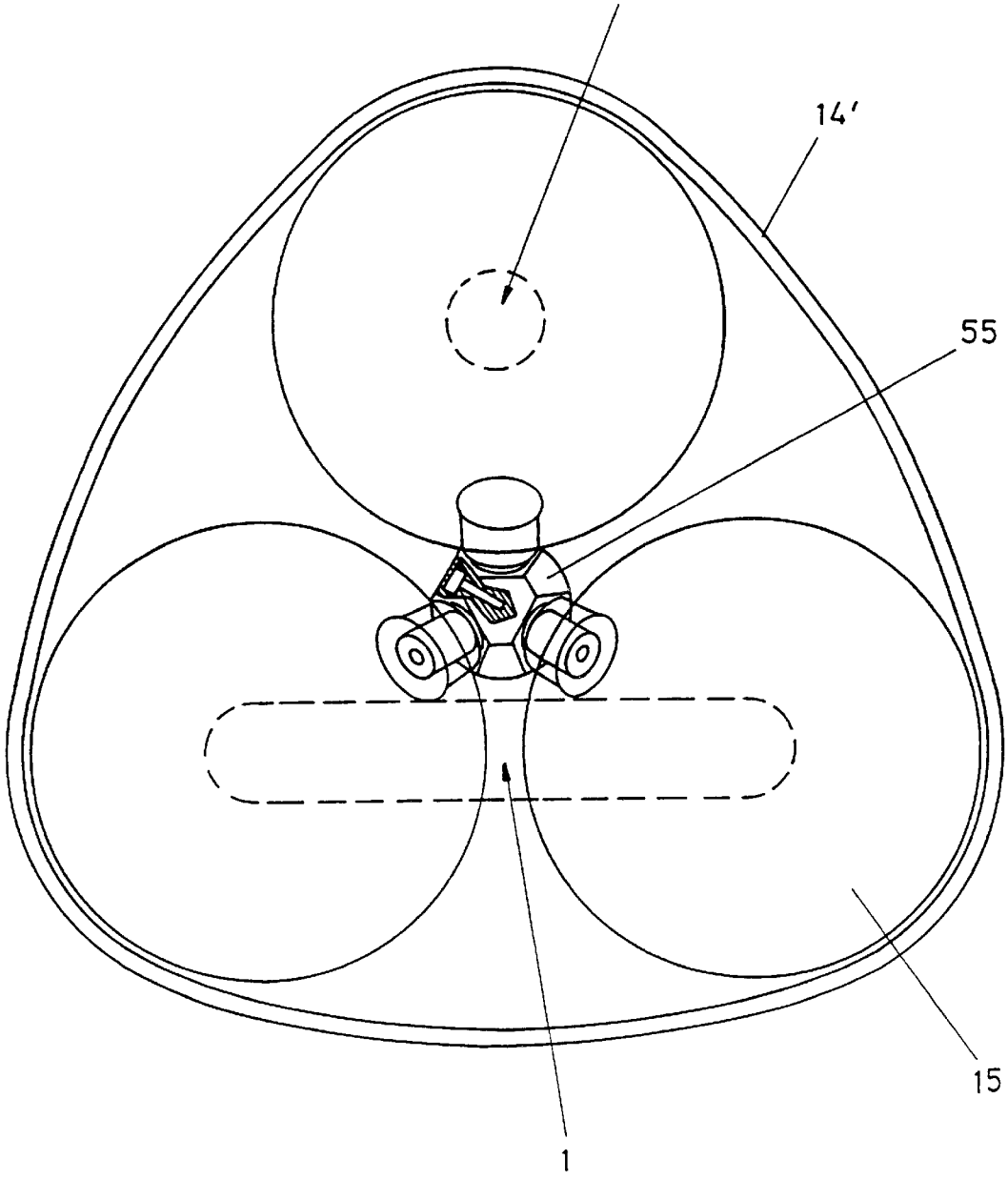
FIG. 9 is a diagrammatic vertical section through a part of the apparatus of FIG. 8.
Figure 10:
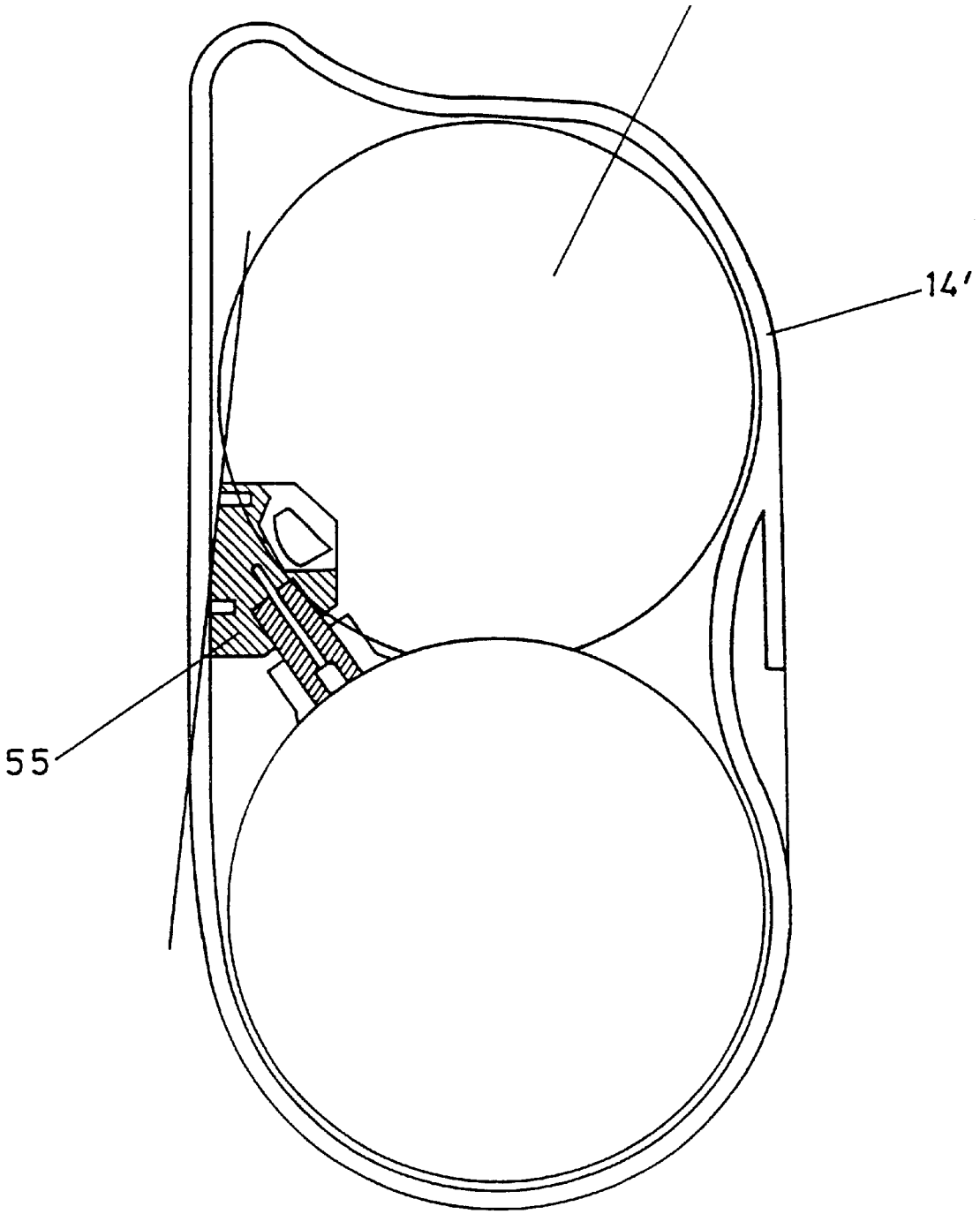
FIG. 10 is a diagrammatic vertical section through a part of the apparatus of FIG. 8 in a plane at right angles to the plane of FIG. 9.

Referring now to FIGS. 5 and 6 there is shown an embodiment which is similar to that shown in FIG. 3 but where the harness additionally includes shoulder straps 20 of webbing and a spinal support plate 21. (Preferably the shoulder straps 20 are adjustable as shown in FIG. 8).

In this case, the waist plate 1 includes an upstanding portion 22 also formed of rigid plastics material to which the spinal support plate 21 is pivotally attached so that it can pivot in a vertical plane laterally with respect to the general direction of movement of the wearer. The spinal support plate 21 is faced with resilient material 23, (similar to material 3) to provide padding for the back and shoulders and includes a projecting boss 24 of circular section and carrying a groove 25 in its outer periphery. The upstanding portion 22 on the waist plate includes an aperture 26 of a dimension which will receive the boss 24. Located at opposite sides of the aperture 23 are clips 27 resiliently mounted within the aperture so that they are urged towards one another. When the boss 24 is introduced into the aperture 26 the clips 27 move apart from one another to allow passage of the boss 24 and then engage in the recess 25 under their resilient bias and lock the spinal support plate 21 in position on the upstanding portion 22 in such a manner that the spinal support plate 21 can pivot with respect to the portion 22.

Figure 7:
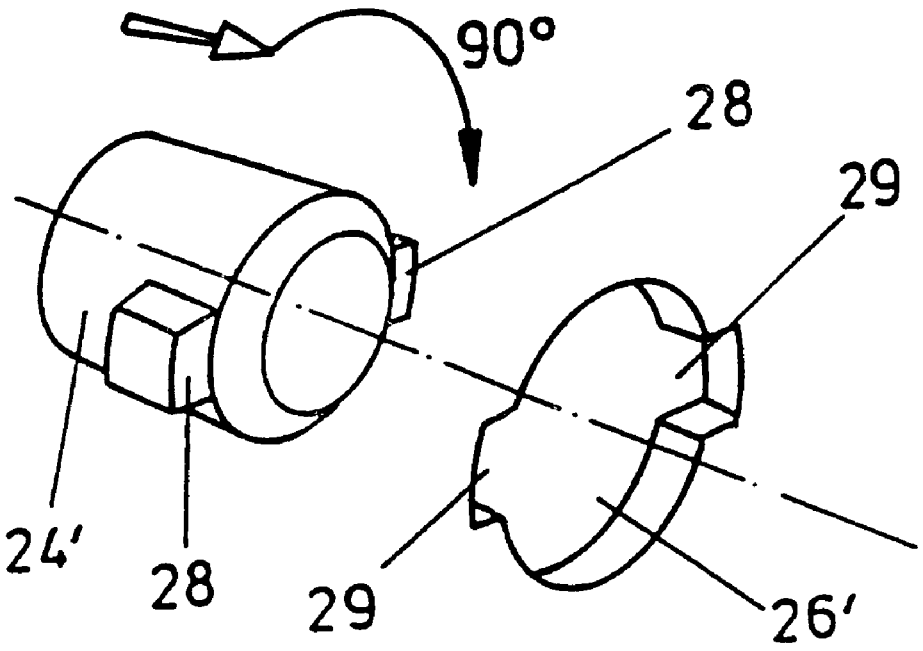
FIG. 7 shows a modification of a portion of the part shown in FIG. 6.

In a variation of the above construction, the boss may be in the form of a projection 24' carrying a pair of diametrically opposed lugs 28 and the aperture 26' may include a pair of diametrically opposite recesses 29 as shown in FIG. 7. The recesses 29 are dimensioned to allow the projection 24' to pass through the aperture when the recesses 29 and lugs 28 are in register and then to retain the projection 24' within the aperture when the spinal support plate 21 is suitably rotated with respect to the upstanding portion 22 so that the lugs 28 and recesses 29 are no longer in register.

Both the above constructions provide a means of quickly connecting the spinal support plate 21 to the upstanding portion 22 in a manner which enables the spinal support plate 21 to pivot with respect to the portion 22.

The upstanding portion 22 includes three of said apertures 26 (26') whereby the spinal support plate 22 may be connected to the waist plate by any of these apertures to allow for the harness to be worn by wearers of significantly differing height.

The spinal support plate 21 includes a plurality of laterally extending thinner portions 30 whereby it is provided with some flexibility in the for and aft direction with respect to the normal direction of motion of the wearer.

The spinal support plate 21 is bifurcated at its upper end and terminates in a first limb 31 and a second limb 32. A first shoulder strap 20 is secured to the first limb 31 at its first end and is provided at its second end with a loop 33 through which the waist belt 9 passes. A second shoulder strap 20 is similarly attached to the second limb 32. In this way, the first ends of the shoulder straps 20 are maintained in their respective positions irrespective of movement of the wearer.

As in the embodiment of FIG. 3, the harness has secured thereto a casing 14 containing a pair of substantially spherical containers 15 for storing breathing gas under pressure.

Referring now to FIGS. 8 to 13 there is shown a breathing apparatus similar to that of FIG. 5 but including three substantially spherical containers 15 arranged at the apices of a triangle within a casing 14'. The three containers are linked together by means of manifold 55. Also, the shoulder straps 20 each includes an adjustable buckle 35 whereby the height of the apparatus with respect to the wearer's back can be adjusted.

The use of such a full harness, as opposed to the waist belt only system of FIG. 3, is preferred when the heavier and more bulky three or more container system is to be used. A connector plate 40 is secured to the waist plate 1 by means of spigots 41 adapted to pass through holes 42 and 43 in reinforcing plate 44 and waist plate 1, respectively, and through holes 45 in connector plate 40 to engage in bores 46 in studs 47 on connector plate 40. Four such studs 47 are provided and each has a domed head 48 of larger dimension than shank portion 49.

The casing 14' for the spherical containers 15 includes four apertures each comprising a slot 50 having a width greater than the diameter of the shank portion 49 but-less than the diameter of the domed head 48 of the studs 47 and a circular portion 51 having a diameter greater than the diameter of the domed portion 48 of the studs 47. The apertures are provided on the casing 14' in such a manner that the circular portions 51 can be put in register with the four studs 47 on the connector plate 40 whereby the studs 46 can pass through the circular portions 50. Then by suitably rotating the casing 14' the shank portions 49 of the studs 47 are caused to pass along the slots 50 whereby the casing and the containers therein are securely attached to the connector plate 40 by the dome portions 48 of the studs 47. Thus, the casing can be quickly connected to the harness.

Figure 14:
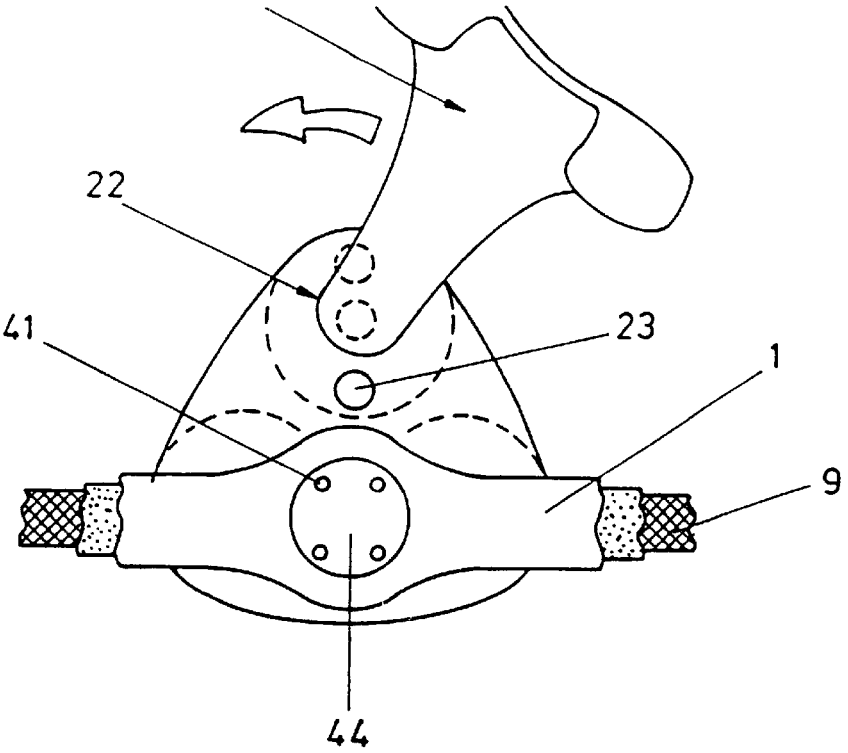
FIG. 14 is a front view of a further part of the apparatus of FIG. 8.
Figure 15:
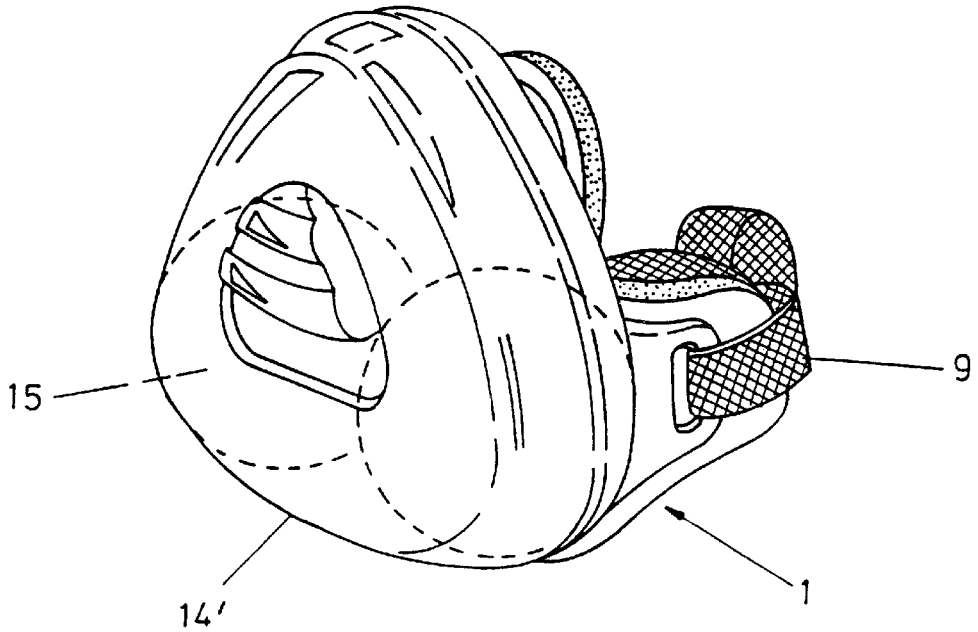
FIG. 15 is a rear perspective view showing the apparatus of FIG. 8 in its folded away configuration.

Referring now to FIGS. 14 and 15 it can be seen that, because of the pivotal mounting of the spinal support plate 21, the harness can be readily folded away for storage or carrying purposes so as to adopt the configuration shown in FIG. 15 by pivoting the spinal support plate 21 through about 180° with respect to the upstanding portion 22 of the waist plate.

Figure 16:
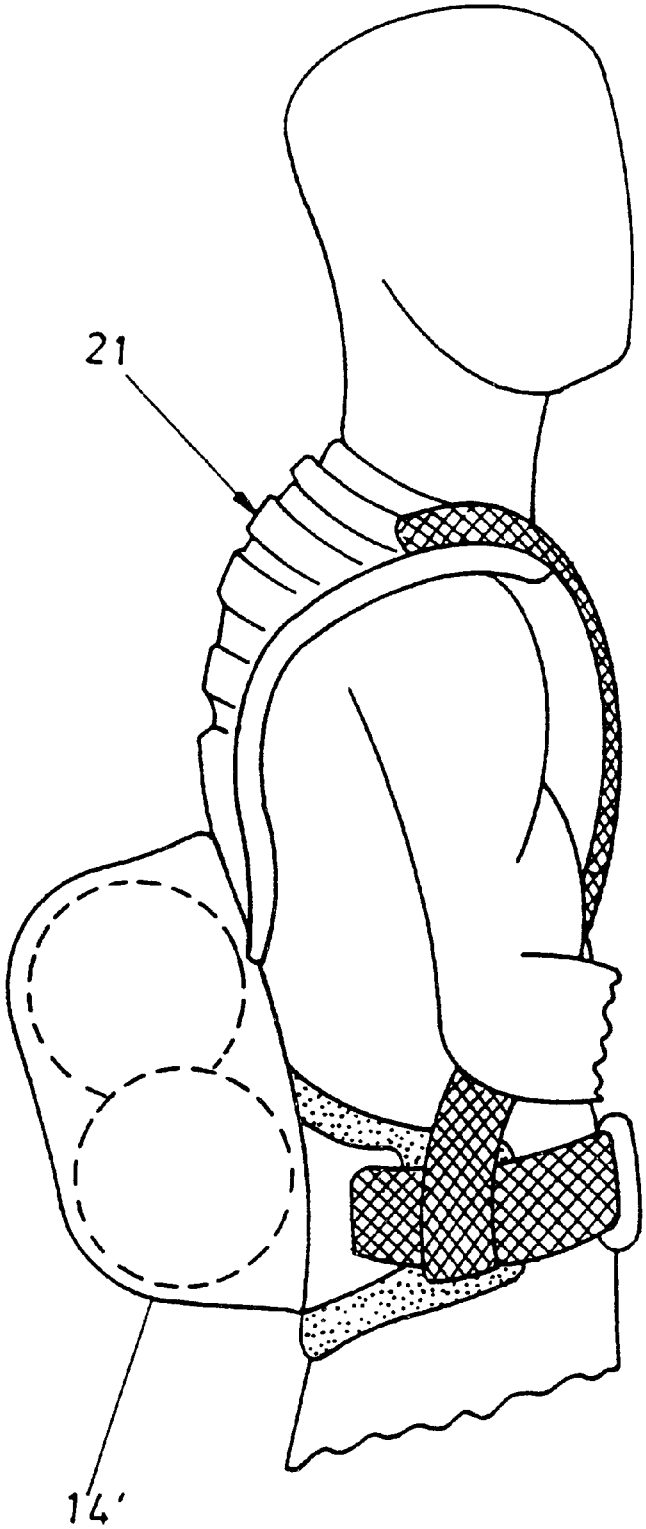
FIG. 16 is a side view of the apparatus of FIG. 8 being worn by the wearer in an upright position, FIG. 17 corresponds to FIG. 16 and shows the wearer in a bent forward position.
Figure 17:
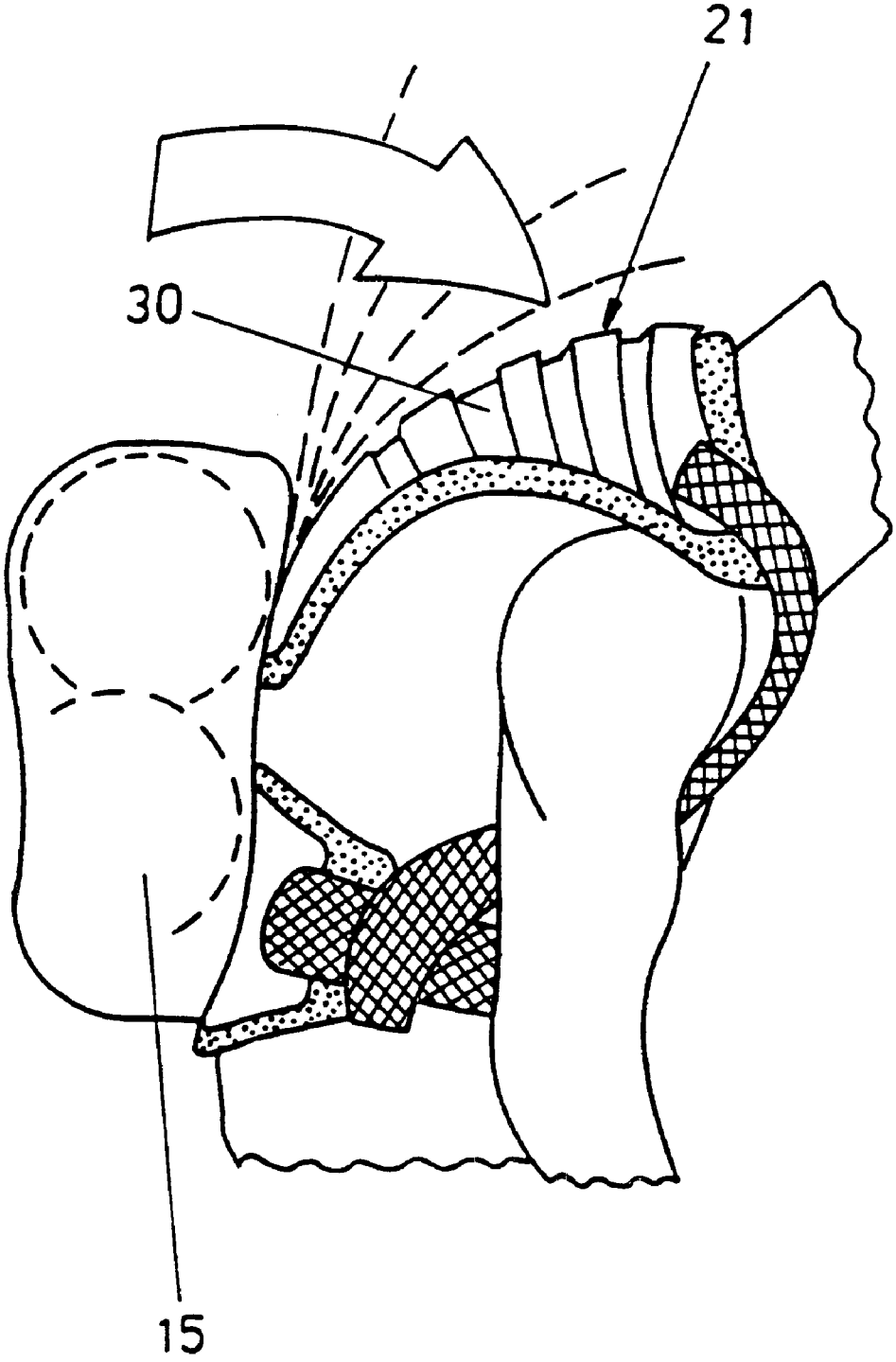

Referring now to FIG. 16, there is shown the harness and apparatus of FIG. 8 secured to the wearer in an upright position. As can be seen from FIG. 17, when the wearer leans forward, the spinal support plate 21 can bend transversely at the thinner portions 30 to facilitate movement of the wearer.

Figure 18:
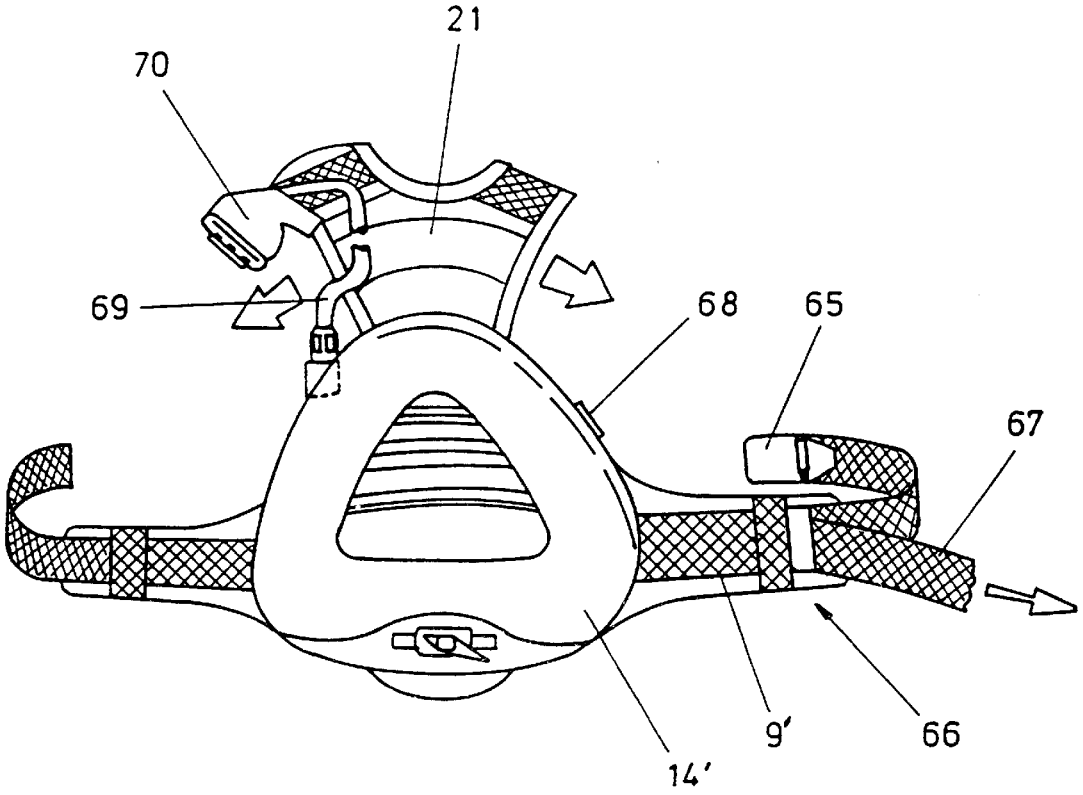
FIG. 18 shows a rear view of a sixth embodiment of breathing apparatus in accordance with the present invention.

Referring now to FIG. 18, there is shown another embodiment of breathing apparatus comprising three spherical containers (not shown) located within a casing 14'. This apparatus also includes a pivotally mounted for and aft flexible spinal support plate 21. The casing 14' includes a first opening 68 whereby all three containers may be charged with breathable gas simultaneously via a high pressure inlet and a second opening (not shown) by means of which one end of a hose 69 is connected to a medium pressure outlet of a reducing valve (not shown), the other end of the hose terminating in a demand valve 70. The waist belt 9' of the apparatus includes a quick release connector 65 and a length adjusting mechanism 66 whereby it may be shortened by pulling on free end number 67 in a manner known per se.

Figure 19:
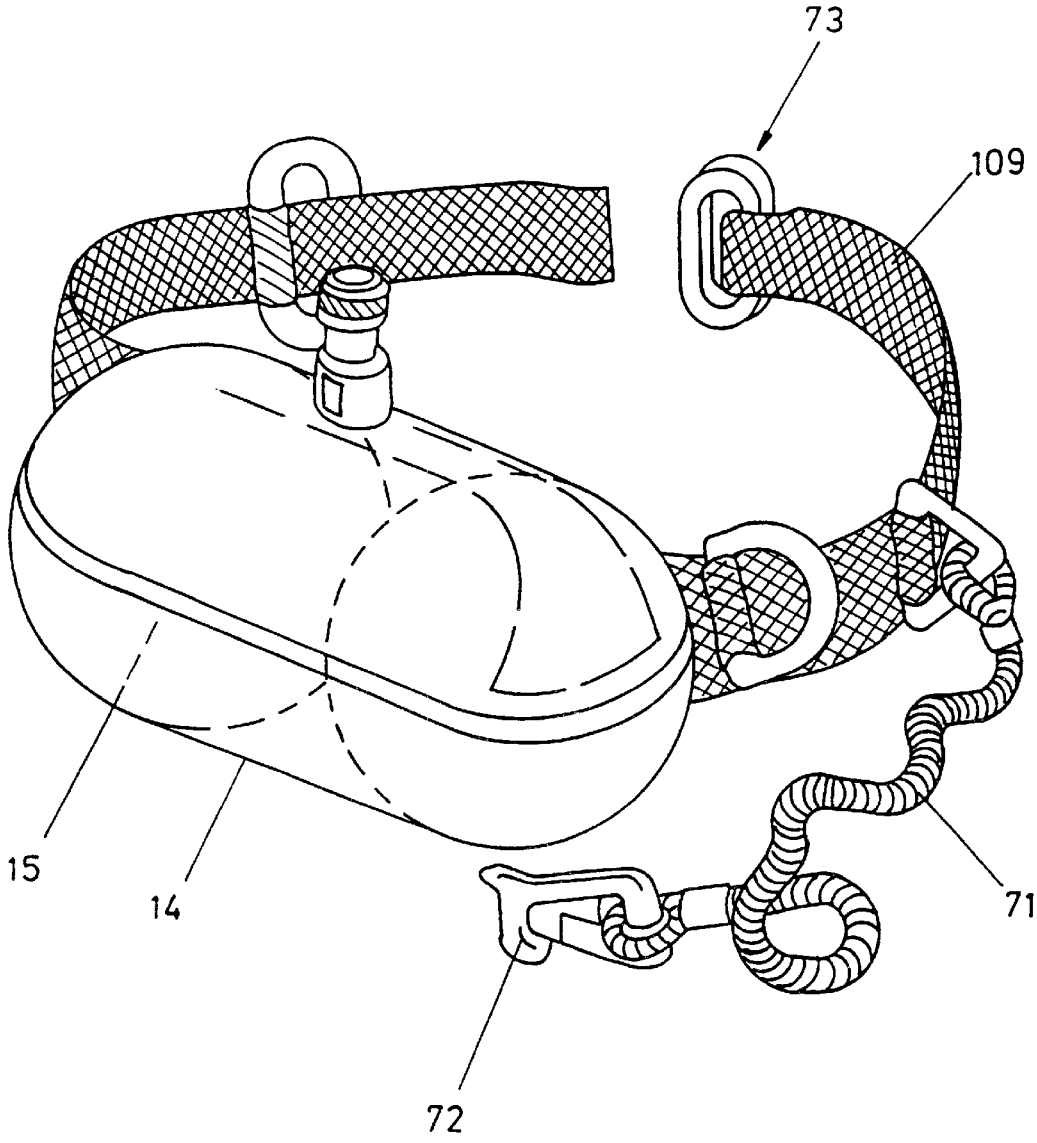
FIG. 19 shows a rear perspective view of a seventh embodiment of breathing apparatus in accordance with the present invention.

Referring now to FIG. 19, this embodiment includes two spherical containers 15 located within a casing 14 similar to the embodiment shown in FIG. 3.

In this case, however, the casing 14 is mounted on a fire fighter's DIN standard safety belt 109 by quick-release connectors (not shown). The fire fighters belt includes a plurality of D-rings whereby various items of equipment may be attached thereto including, as shown, a rope 71 terminating in a carabiner 72 whereby the wearer may hook himself onto a suitable attachment point. One end of the belt includes a fastening means comprising a pair of rings 73 to which the free other end of the belt may be connected in a manner known per se.

Figure 20:
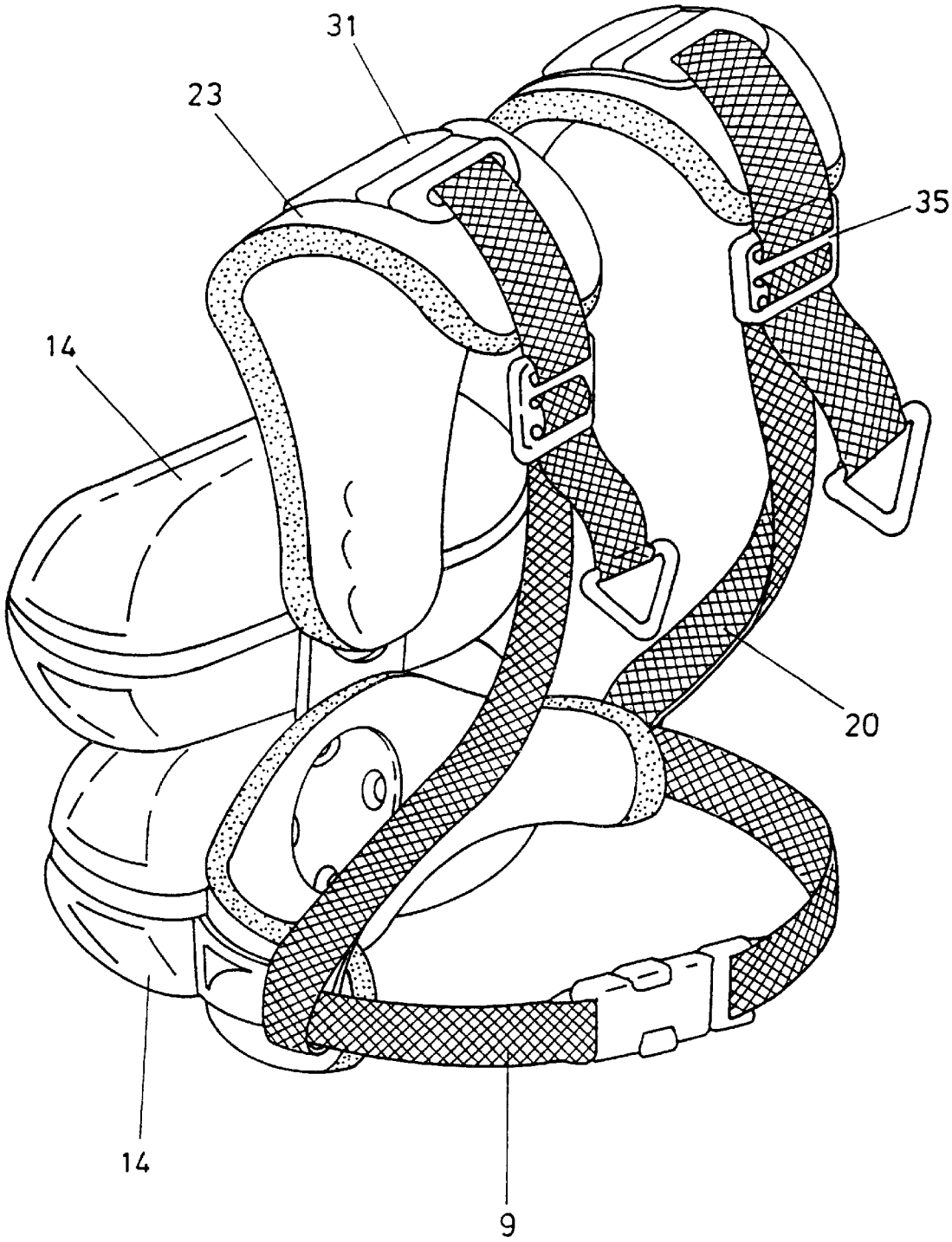
FIG. 20 shows a front perspective view of an eighth embodiment of breathing apparatus in accordance with the present invention.
Figure 21:
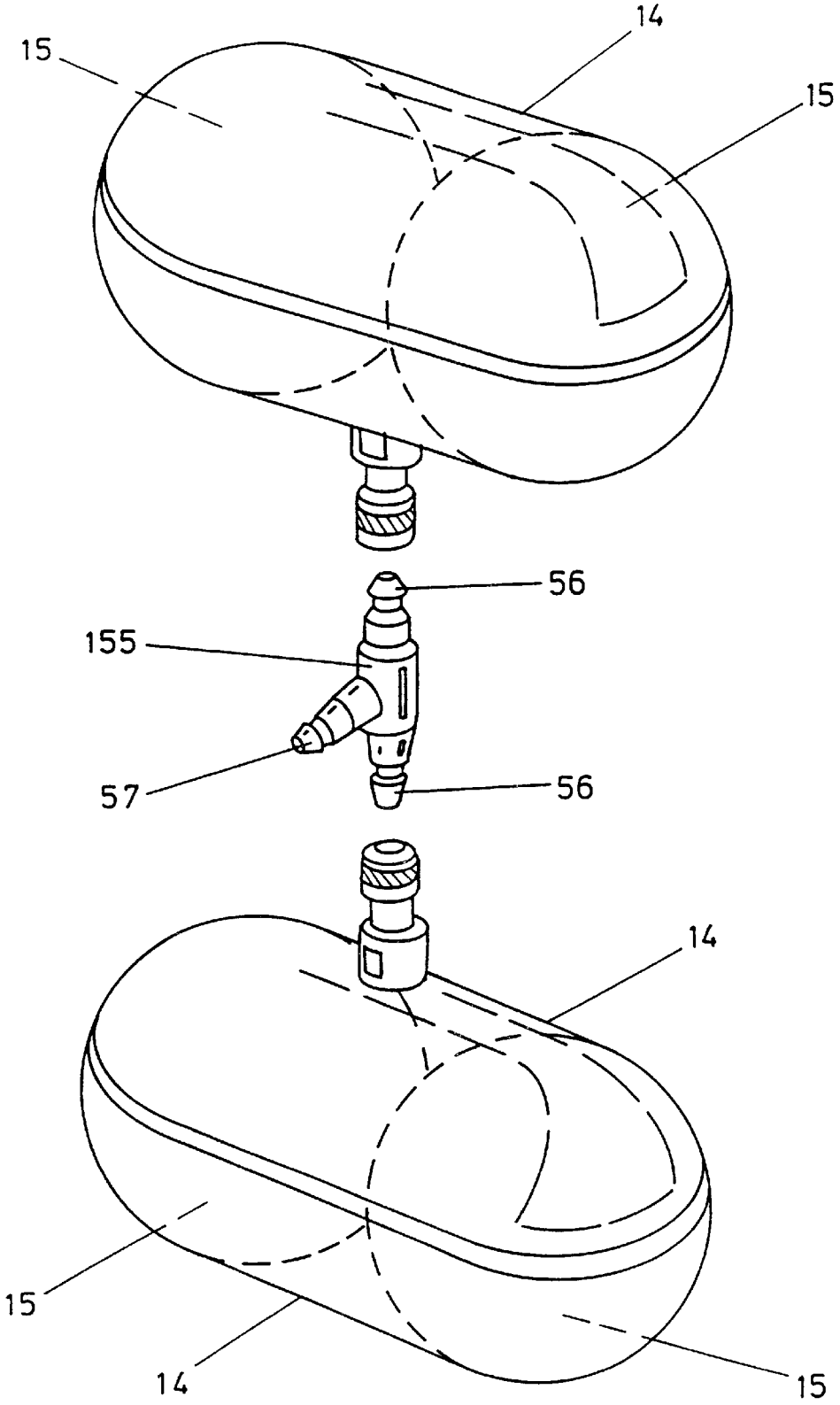
FIG. 21 shows a part of the breathing apparatus of FIG. 20.

Referring to FIGS. 20 and 21, there is shown a breathing apparatus incorporating a first pair of spherical containers 15 in a first casing 14 and a second pair of spherical containers 15 in a second casing 14. Each pair of containers includes a common female connector and the female connectors are joined together by a manifold 155 comprising first and second oppositely facing male connectors 56 and a third male connector 57 leading to the pressure reducer (not shown) and high pressure inlet (not shown). Such an arrangement is preferably used with a full harness as shown in FIGS. 5 or 8 because of the additional weight.

What is claimed is:

1. A breathing apparatus comprising:

(i) at least two substantially spherical containers for holding breathable gas under pressure, and (ii) a harness to which the at least two containers are attached for securing the at least two containers to the user.

2. An apparatus as claimed in claim 1 wherein not more than two containers are present and the harness is in the form of a waist belt or waist coat for fastening around the user.

3. An apparatus as claimed in claim 2 wherein the waist belt is in the form of a fire-fighter's safety belt with each container attached thereto.

4. An apparatus as claimed in claim 1 wherein not more than two containers are present and the harness is in the form of a bandolier arranged to extend diagonally around the body of the user.

5. An apparatus as claimed in claim 1 wherein the substantially spherical containers are formed from resin impregnated graphite fibres.

6. An apparatus as claimed in claim 1 wherein the containers are connected together by a manifold.

7. An apparatus as claimed in claim 1 which includes a protective casing for the substantially spherical containers.

8. An apparatus as claimed in claim 6 wherein two similar containers are located side-by-side within the casing.

9. An apparatus as claimed in claim 8 wherein the casing includes sufficient space to accommodate a third similar container above said two containers so that the containers are located at the apices of a triangle.

10. An apparatus as claimed in claim 7 wherein four containers are present, the containers being located in pairs with one pair above the other and each pair in its own separate protective casing with the casings interlocked together.

* * * * *

UNITED STATES PATENT AND TRADEMARK OFFICE

CERTIFICATE OF CORRECTION

PATENT NO. : 6,405,728 B1
DATED : June 18, 2002
INVENTOR(S) : Maurice Van Hall et al.

It is certified that error appears in the above-identified patent and that said Letters Patent is hereby corrected as shown below:

Title page,
Item [56], References Cited, U.S. PATENT DOCUMENTS,
"4,205,816" should be -- 4250876 --

Column 8,
Line 12, "claim 6" should be -- claim 5 --.

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,405,728 B1
DATED : June 18, 2002
INVENTOR(S) : Maurice Van Hall et al.

It is certified that error appears in the above-identified patent and that said Letters Patent is hereby corrected as shown below:

Title page,
Item [*] Notice, delete "0" and insert -- 761 --.

Signed and Sealed this

Twenty-third Day of March, 2004

JON W. DUDAS
*Acting Director of the United States Patent and Trademark Office*